US005432976A

United States Patent [19]

Alazet

[11] Patent Number: 5,432,976

[45] Date of Patent: Jul. 18, 1995

[54] DEVICE FOR COLLECTING REFUSE AND DUST

[75] Inventor: Jean Alazet, Paris, France

[73] Assignee: Novus, Paris, France

[21] Appl. No.: 171,416

[22] Filed: Dec. 22, 1993

[30] Foreign Application Priority Data

Dec. 23, 1992 [FR] France ..... 92 15587

[51] Int. Cl.[6] ..... A47L 5/24

[52] U.S. Cl. ..... 15/344; 15/350; 15/398

[58] Field of Search ..... 15/344, 350, 398, 399, 15/400

[56] References Cited

U.S. PATENT DOCUMENTS 1,345,424 7/1920 Wasenska ..... 15/398 X
1,930,778 10/1933 Skidelsky ..... 15/344
3,903,564 9/1975 Morinaga .
4,454,627 6/1984 Simm et al. ..... 15/344 X
4,459,720 7/1984 Ahlf et al. ..... 15/416 X
5,341,541 8/1994 Sham ..... 15/344 X

FOREIGN PATENT DOCUMENTS 1938635 5/1966 Germany .
1959657 5/1967 Germany .
9206415 10/1992 Germany .

*Primary Examiner*—Christopher K. Moore
*Attorney, Agent, or Firm*—Young & Thompson

[57] ABSTRACT

Device for collecting refuse and dust comprising a body (2) of elongate shape carrying a set of bristles (3). The body (2) is hollow so as to contain, in its interior, a chamber (4) for receiving refuse and dust.

6 Claims, 2 Drawing Sheets

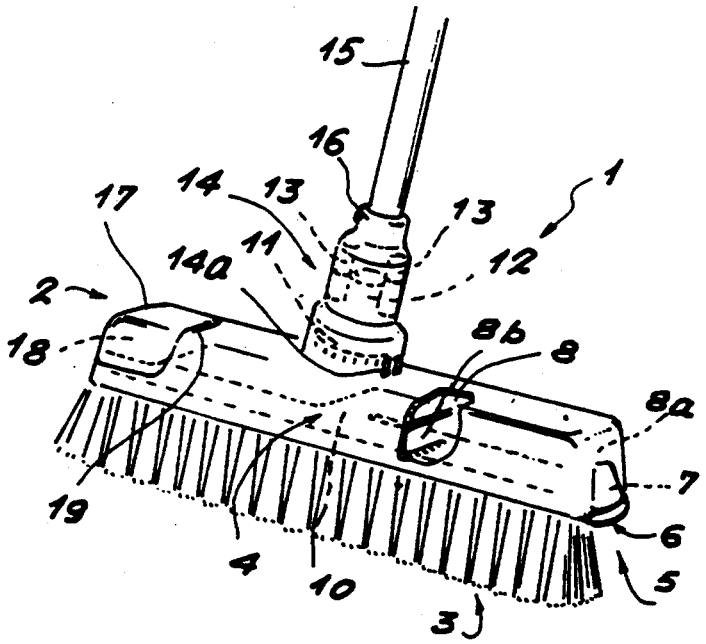
FIG. 1
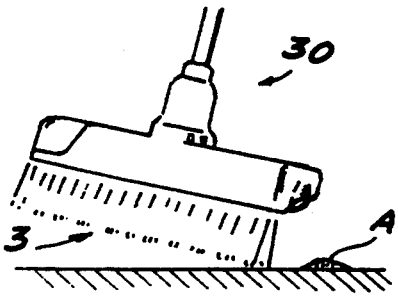
FIG. 3
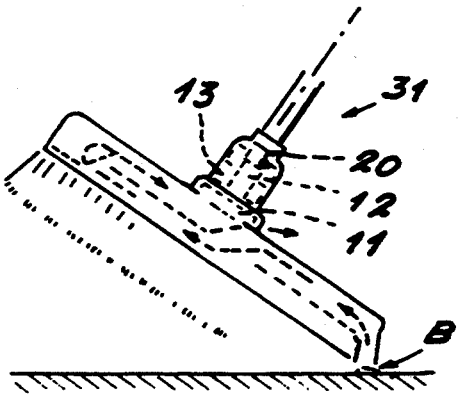
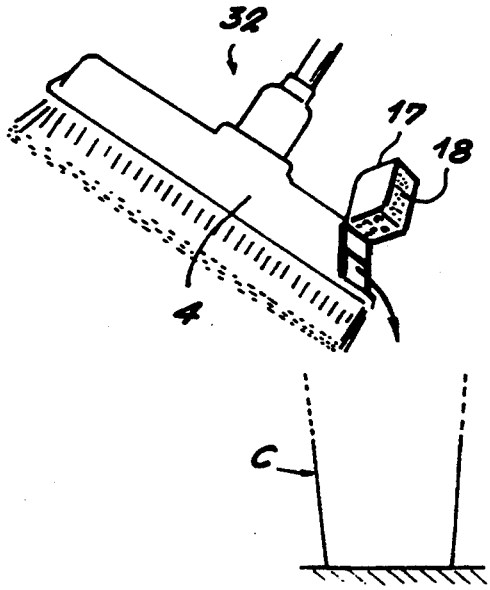

DEVICE FOR COLLECTING REFUSE AND DUST

FIELD OF THE INVENTION

The invention relates to a device for collecting refuse and dust.

BACKGROUND OF THE INVENTION

Collecting devices such as domestic vacuum cleaners are known of which the use necessitates the employment of disposable paper bags intended to contain the aspirated refuse and dust and generally consisting of a unit which is capable of travelling on wheels and comprises a motor driving a suction turbine and a suction head connected by a flexible tube to said unit.

These known vacuum cleaners have several disadvantages:

- the disposable bag containing the dust remains permanently in said container and this leads to a proliferation of microbes which is incompatible with applications requiring a high degree of hygiene or security,
- as the unit capable of travelling on wheels is heavy and is relatively bulky, it is not possible to reach tight corners or locations where there are heaps of dust and refuse.

The object of the invention is to facilitate the collection of refuse and dust in all locations, even tight locations, using a novel light device which is simple in design and economical to produce.

SUMMARY OF THE INVENTION

The invention relates to a device for collecting refuse and dust of the type comprising a body of elongate shape carrying a set of bristles, characterised in that the body is hollow so as to contain, in its interior, a chamber for receiving refuse and dust.

According to further characteristics of the invention:

- the body has an orifice for the suction or collection of dust and refuse at one longitudinal and,
- the body has a flap for the discharge of dust and refuse at one longitudinal and,
- the device comprises a portion which is substantially perpendicular to the body receiving a suction means such as a turbine driven by an electric motor,
- the device comprises a gravitationally-activated electric contact means which is actuated when the body of the device is rocked through an angle so as to bring one end of the body toward the ground corresponding to the suction of dust and refuse,
- the device comprises a filtration means located in the region of the discharge flap,
- the device comprises means for the mechanical driving of dust and refuse in the immediate vicinity of the orifice for the collection of dust and refuse,
- the mechanical driving means comprise at least one rotating brush,
- the rotating brush is electrically set into rotation round an axis,
- the axis of the rotating brush is transversal to the body of the device.

BRIEF DESCRIPTION OF THE DRAWINGS

The invention will be understood better by means of the following description given as a non-limiting example with regard to the accompanying drawings.

FIG. 1 is a schematic perspective view, partially broken away, of a device according to the invention.

FIG. 3 is a schematic view of the device according to the invention in use.

DETAILED DESCRIPTION OF THE INVENTION

Figure 2:
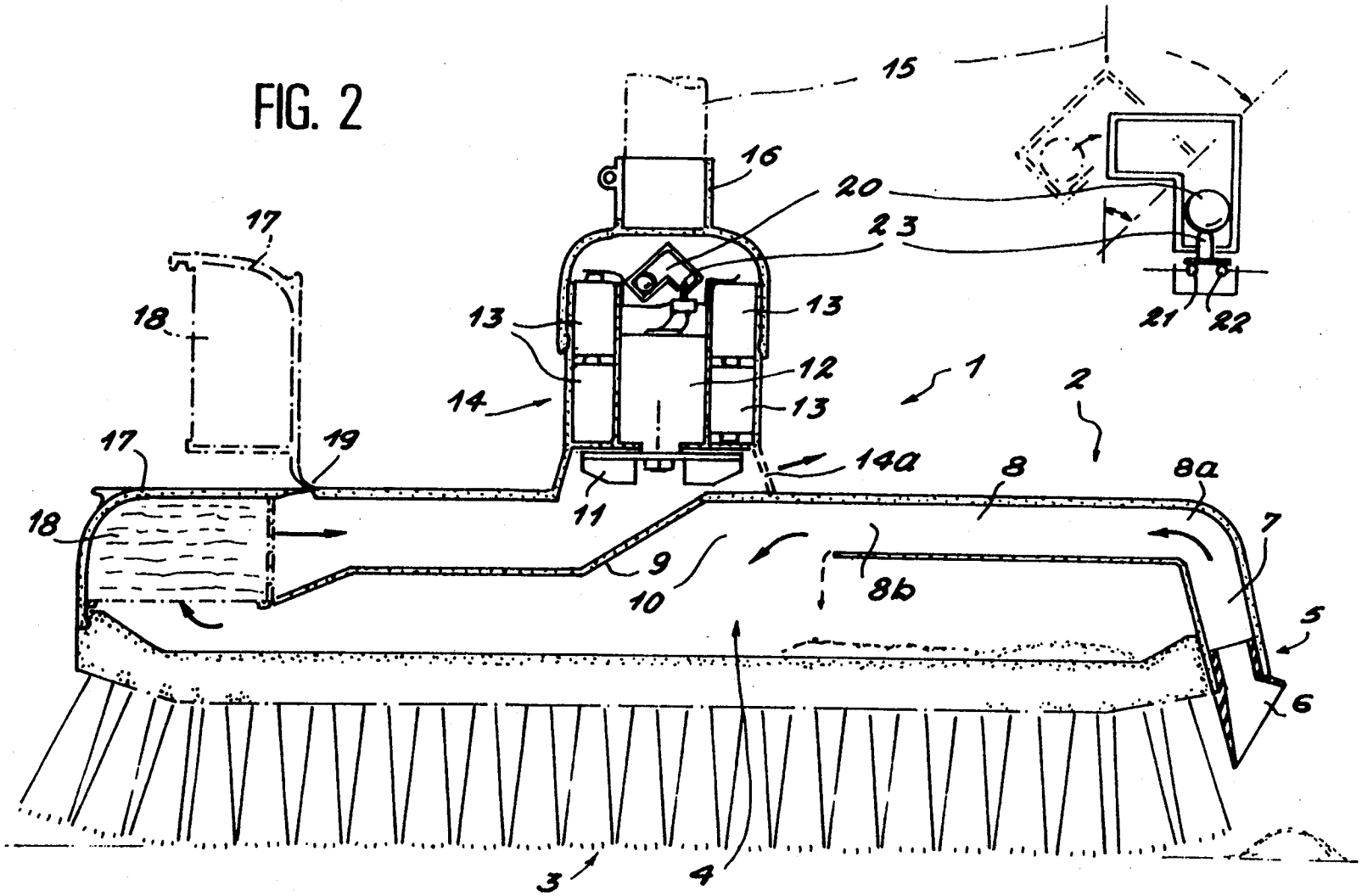
FIG. 2 is a schematic cross section of a device according to the invention.

With reference to FIGS. 1 and 2, a device 1 according to the invention comprises a body 2 of elongate shape carrying a set of bristles 3 preferably arranged in several rows at its lower end.

The body 2 is hollow so as to contain, in its interior, a chamber 4 for receiving refuse and dust which enter through an orifice 5 located at one longitudinal end of the body 2 and extending transversely over the width of said end of the body.

The orifice 5 has a mouthpiece 6 forming an angle with the lower plane of the body 2 on which the bristles 3 are implanted.

The orifice 5 is extended upwardly by a vertical conduit 7 which narrows substantially in the direction of the height and, in turn, opens into one end **8*a* of a substantially horizontal channel 8 occupying substantially half of the width of the body 2**.

The horizontal channel 8 comprises, at its other end **8*b*, an end partition 9 which is inclined in the downward direction so as to open with an orifice 10 into the receiving chamber 4**.

The receiving chamber 4 extends substantially over the entire length and the entire width of the body 2 so as to afford a maximum receiving volume.

The refuse and dust are driven through the mouthpiece 6 of the orifice 5 via the vertical conduit 7 then the channel 8 into the receiving chamber 4 owing to the vacuum and the suction created by a suction turbine 11 driven by an electric motor 12 supplied by rechargeable electric batteries 13.

The electric motor 12 driving the turbine 11 and the batteries 13 are preferably accommodated in a part 14 extending perpendicularly to the body 2, said part being capable of receiving a gripping handle 15 of a known type in a fixing sleeve 16.

A switch (not shown) for controlling the supply of the electric motor 12 may be located on the handle so as to allow the chamber 4 to be subjected to vacuum without sinking or without raising the device to the vertical.

The receiving chamber 4 is provided with a discharge flap 17 which is advantageously located at the end of the body 2 remote from the end comprising the orifice 5.

The discharge flap 17 is adjacent to a filtration means 18 allowing the passage of air but retaining the dust so that the dust does not pass through the turbine 11 and issue via the air evacuating orifices **14*a* provided on the part 14 perpendicular to the body 2**.

In the preferred variation illustrated, the filter 18 is connected to the discharge flap 17 so that the opening of the flap 17 allows the replacement of the filter 18 which rocks with the flap 17 round a hinge 19 when the flap 17 is opened.

The discharge flap 17 is located in the top portion of the body 2 remote from the bristles 3 in this example. The invention also covers the case of a discharge flap fitted terminally into the end of the body 2 so as to allow the washing and inspection of the chamber 4 over the entire cross section of this chamber 4.

In the variation illustrated, a gravity-actuated electric contact allows the supply and starting of the electric motor 12 when the body 2 of the device is inclined in the direction bringing the mouthpiece 6 toward the ground or the similar surface to be cleaned.

This gravitationally-actuated electric contact consists, for example, of a ball 20 which establishes a short circuit between two segments 21, 22 of a similar closure switch 23 or contact.

With reference to FIG. 3, three devices 30, 31, 32 according to the invention are shown in three successive positions of use.

The device 31 is used as an ordinary broom carrying bristles 3 so as to form a small heap A of dust and refuse.

The device 31 is shown in the position of suction of a small heap B of dust and refuse: the suction is achieved in that the electric motor 12 supplied by electric batteries 13 by means of the gravitationally-actuated electric contact 20 drives the suction turbine 11.

The device 32 is illustrated in the position for emptying the chamber 4 into a receptacle C since the discharge flap 17 is open and advantageously locked in the open position by known locking arrangements.

Thus, owing to the invention, dust and refuse are collected after sweeping with a single device allowing discharge and cleaning immediately after use.

For applications with particularly demanding conditions in terms of asepsis or contamination control, the part 14 will be made perpendicular to the separable body 2 in a variation so as to allow separate treatment of the body 2 in appropriate installations.

Although described with reference to particular embodiments, the invention is not limited to them but, on the other hand, covers any variation in the scope and spirit of the invention: thus, the means for driving dust may advantageously be replaced by an electric brush mounted so as to rotate round a substantially horizontal axis which is transversal to the body of the device, in the immediate vicinity of the dust and refuse collecting orifice.

I claim:

1. A device for collecting refuse and dust comprising: a body of elongate shape carrying a set of bristles, said body being hollow, so as to contain in its interior, a chamber, said body having at one longitudinal end outside said set of bristles, an orifice communicating with said chamber, said body being secured to a gripping handle so as to operate said device as a broom, said device further including suction means for creating an air flow through said orifice into the hollow interior of the body, for the collection of dust and refuse.

2. A device according to claim 1, wherein the body has, at a longitudinal end opposite said one end, a flap for the discharge of dust and refuse.

3. A device according to claim 2, further including filtration means adjacent the flap.

4. A device according to claim 1, further including a part which is substantially perpendicular to the body for housing the suction means, and said suction means comprising a fan driven by an electric motor.

5. A device according to claim 4, further comprising gravitationally-actuated electrical contact means for actuating said motor when the body of the device is rocked through an angle and brings said one end of the body toward the ground for the suction of dust and refuse.

6. A device according to claim 1, wherein the orifice includes a mouth piece which forms an angle with a lower plane of the body on which the said bristles are carried.

* * * * *